United States Patent [19]

Kobeck et al.

[11] Patent Number: 4,750,640

[45] Date of Patent: Jun. 14, 1988

[54] SANITARY NAPKIN HOME DISPENSER

[76] Inventors: Richard Kobeck; Mildred Kobeck, both of 2507 Cruger Ave., Bronx, N.Y. 10467; George Spector, 77 Fulton St., New York, N.Y. 10038

[21] Appl. No.: 49,153

[22] Filed: May 13, 1987

[51] Int. Cl.[4] ..... B65G 59/06

[52] U.S. Cl. ..... 221/186; 221/190; 221/281; 221/282; 221/306

[58] Field of Search ..... 221/186, 190, 197, 281, 221/282, 286, 303, 306, 66, 312 R, 312 B, 312 C, 248, 250

[56] References Cited

U.S. PATENT DOCUMENTS 3,860,304 1/1975 Bolton ..... 221/59 X
4,275,819 6/1981 Perez ..... 221/186

FOREIGN PATENT DOCUMENTS 164684 6/1921 United Kingdom ..... 221/186

*Primary Examiner*—Charles A. Marmor

[57] ABSTRACT

A home sanitary napkin dispenser is provided that can be mounted to a vertical flat surface out of the way in an inconspicuous place. The dispenser allows for easy access to one sanitary napkin at a time when the dispenser is activated by a person needing the sanitary napkin.

4 Claims, 1 Drawing Sheet

SANITARY NAPKIN HOME DISPENSER

BACKGROUND OF THE INVENTION

The instant invention relates generally to dispensing devices and more specifically it relates to a home sanitary napkin dispenser.

Numerous dispensing devices have been provided in prior art that are adapted to deliver articles of merchandise one at a time therefrom. For example, U.S. Pat. Nos. 2,163,081; 2,218,657 and 4,170,325 all are illustrative of such prior art. While these units may be suitable for the particular purpose to which they address, they would not be as suitable for the purposes of the present invention as heretofore described.

SUMMARY OF THE INVENTION

A primary object of the present invention is to provide a home sanitary napkin dispenser that will overcome the shortcomings of the prior art devices.

Another object is to provide a home sanitary napkin dispenser that allows easy access to one sanitary napkin at a time when the dispenser is activated by a person needing the sanitary napkin.

An additional object is to provide a home sanitary napkin dispenser that can be mounted to a vertical flat surface out of the way in any inconspicuous place.

A further object is to provide a home sanitary napkin dispenser that is simple and easy to use.

A still further object is to provide a home sanitary napkin dispenser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
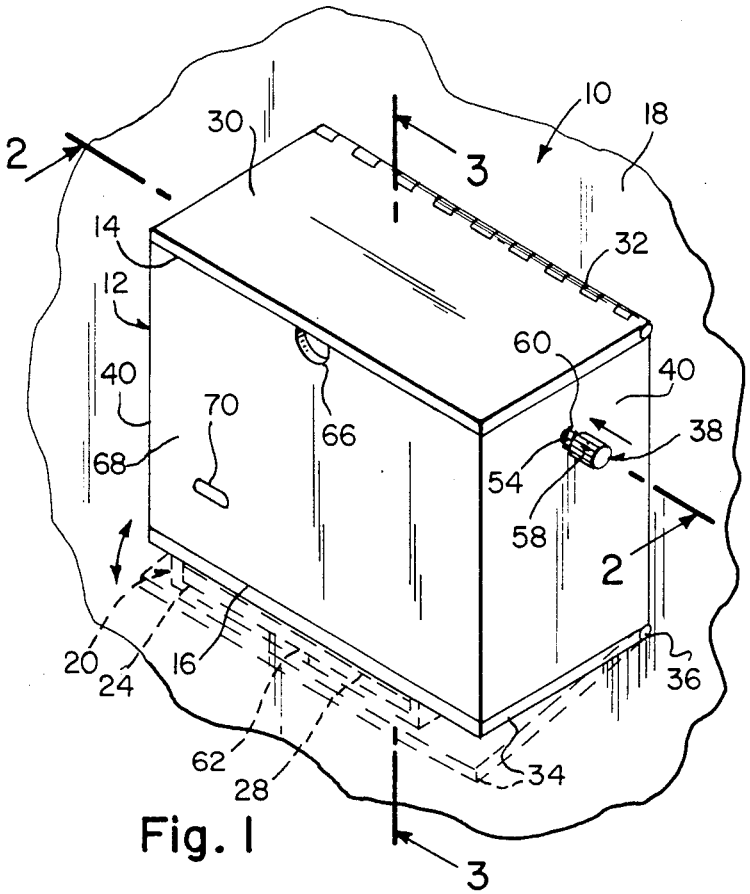
FIG. 1 is a perspective view of the invention.
Figure 2:
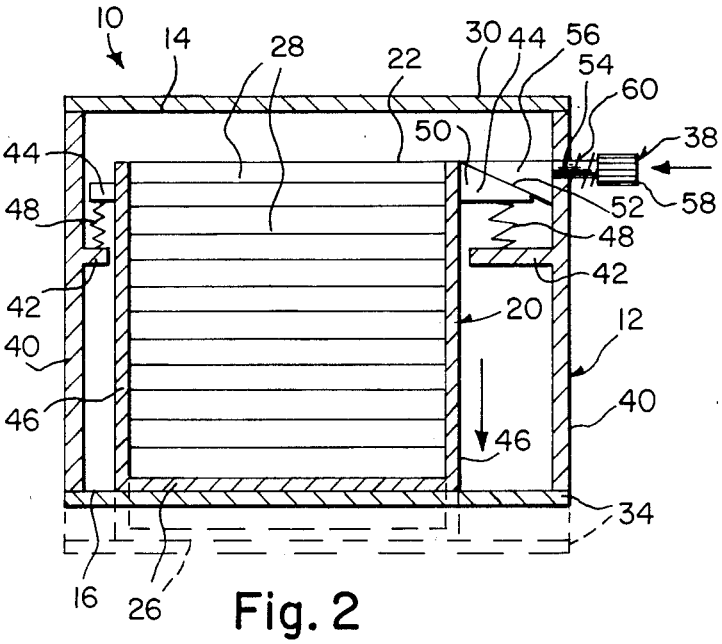
FIG. 2 is a cross sectional view taken along line 2—2 in FIG. 1 showing the moveable tray within.
Figure 3:
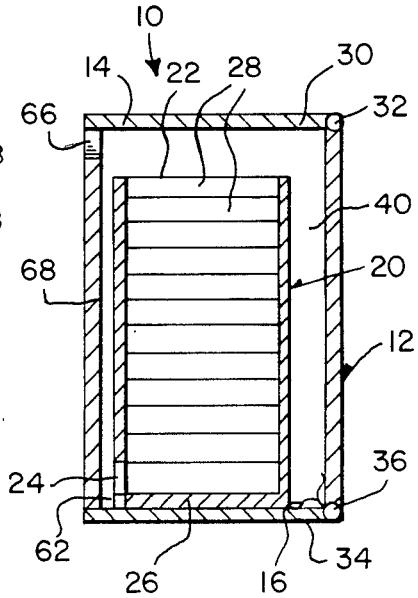
FIG. 3 is a cross sectional view taken along line 3—3 in FIG. 1 thereof.

Turning now descriptively to the drawings, in which similar reference characters denote similar elements throughout the several views, FIGS. 1, 2 and 3 illustrate a home sanitary napkin dispenser 10 that consists of an elongated receptacle 12 that has an open top 14 and open bottom 16. The receptacle 12 is mounted to a vertical flat surface 18 such as a wall. A tray 20 is moveably disposed within the receptacle 12. The tray 20 has an open top 22 and a front slot 24 near bottom 26 thereof. A plurality of sanitary napkins 28 are placed stacked within the tray 20 with lowest of the sanitary napkins 28 in alignment with the slot 24 in the tray 20.

A lid 30 is hinged at 32 to top 14 of the receptacle 12 to open so as to allow placing of the sanitary napkins 28 therein. A bottom door 34 is spring biased closed at 36 to bottom 16 of the receptacle 12. A spring action lever 38 on side wall 40 of the receptacle 12 is for moving the tray 20 downwardly to open the bottom door 34 exposing the lowest of the sanitary napkins 28 so as to be removed through the front slot 24 of the tray 20.

The home sanitary napkin dispenser 10 further contains a first pair of flanges 42, each extending inwardly from an opposite side wall 40 of the receptacle 12 near the open top 14 thereof. A second pair of flanges 44, each extend outwardly from an opposite side 46 of the tray 20 near the open top 22 thereof.

A pair of return springs 48 are also provided. Each are placed between one of the receptacle flanges 42 and the tray flanges 44 to support the tray 20 and allowing the tray to move a predetermined distance downward to expose lowest of the sanitary napkins 28 and then return the tray 20 to its normal position within the receptacle 12.

The spring action lever 38 includes one of the second pair of flanges 44 being shaped like a wedge 50 that has an angular surface 52 on top. A shaft 54 extends through the side wall 40 of the receptacle 12 has a second wedge 56 formed on inner end thereof to engage with the angular surface 52 of the first wedge 50. A push button 58 is formed on outer end of the shaft 54 thereof. A spring 60 is disposed on the shaft 54 between the side wall 40 of the receptacle 12 and the push button 58 to return the spring action lever 38 to its normal position in the side wall 40.

Figure 4:
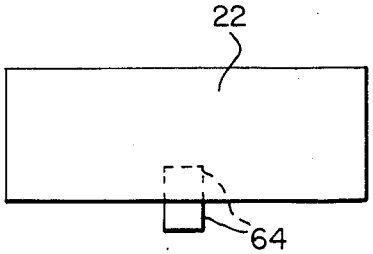
FIG. 4 is a top view of one of the napkins showing a pull tap thereon.
Figure 5:
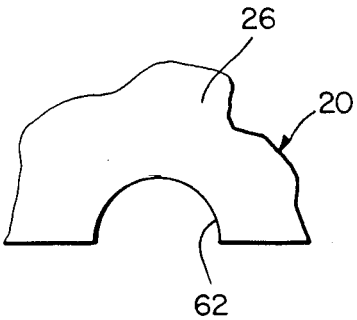
FIG. 5 is a top view of the notch in the tray as shown in FIG. 3.

The tray 20 has a notch 62 in the bottom 26 at the front slot 24 thereof (see FIG. 5). A pull tab 64 as shown in FIG. 4, is provided on each of the sanitary napkins 22 so that the notch 62 and the pull tab 64 will assist a person in removing lowest of the sanitary napkins 28 therefrom.

The receptacle 12 can also have a top notch 66 in front wall 68 below the lid 30 so that the person can easily open the lid to refill the sanitary napkins 28. A see through viewer 70 can also be provided in the front wall 68 to let the person know when the sanitary napkins 28 are low so as to be refilled therein.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A home sanitary napkin dispenser, which comprises:

(a) an elongated receptacle having an open top and open bottom, said receptacle mounted to a vertical flat surface;

(b) a tray moveably disposed within said receptacle, said tray having an open top and a front slot near bottom thereof;

(c) a plurality of sanitary napkins placed stacked within said tray with lowest of said sanitary napkins in alignment with the slot in said tray;

(d) a lid hinged to top of said receptacle to open so as to allow placing of said sanitary napkins therein;

(e) a bottom door spring biased closed to bottom of said receptacle; and (f) means on side wall of said receptacle for moving said tray downwardly to open said bottom door exposing the lowest of said sanitary napkins so as to be removed through the front slot of said tray.

2. A home sanitary napkin dispenser as recited in claim 1, further comprising:

(a) a first pair of flanges, each extending inwardly from an opposite side wall of said receptacle near the open top thereof;

(b) a second pair of flanges, each extending outwardly from an opposite side of said tray near the open top thereof; and (c) a pair of return springs, each placed between one of said receptacle flanges and said tray flanges to support said tray and allowing said tray to move a predetermined distance downward to expose lowest of said sanitary napkins and then return said tray to its normal position within said receptacle.

3. A home sanitary napkin dispenser as recited in claim 2, wherein said moving means is a spring action lever which includes:

(a) one of said second pair of flanges being shaped like a wedge having angular surface on top;

(b) a shaft extending through said side wall of said receptacle having a second wedge formed on inner end thereof to engage with the angular surface of said first wedge and a push button formed on outer end thereof; and (c) a spring disposed on said shaft between said side wall of said receptacle and the push button to return said spring action lever to its normal position in said side wall.

4. A home sanitary napkin dispenser as recited in claim 3, further comprising:

(a) said tray having a notch in the bottom at the front slot thereof; and (b) a pull tab provided on each of said sanitary napkins so that said notch and said pull tab will assist a person in removing lowest of said sanitary napkins therefrom.

* * * * *